US006344970B1

(12) United States Patent
Geitz

(10) Patent No.: US 6,344,970 B1
(45) Date of Patent: Feb. 5, 2002

(54) RECEPTION PODIUM

(75) Inventor: Lynn Marie Geitz, Springfield, MO (US)

(73) Assignee: John Q. Hammons Hotels, Inc., Springfield, MO (US)

( * ) Notice: Subject to any disclaimer, the term of this patent is extended or adjusted under 35 U.S.C. 154(b) by 0 days.

(21) Appl. No.: 09/540,084

(22) Filed: Mar. 31, 2000

(51) Int. Cl.[7] ..... H05K 7/20

(52) U.S. Cl. ..... 361/687; 361/683; 361/695; 364/223.3; 165/122

(58) Field of Search ..... 361/687, 692, 361/695, 683; 312/194, 195, 223.3, 197, 239, 249.9, 321, 317.1, 140.1, 196, 315, 200, 204, 309; 108/33–38, 50, 94, 41, 103; D6/422, 425, 427, 428, 419–420; 165/122, 104.33, 104.34, 104.14; 174/15.1, 16.1, 16.3; 177/245.2, 136, 3–4

(56) References Cited

U.S. PATENT DOCUMENTS 4,736,689 A * 4/1988 Stanko ..... 108/5
4,949,218 A * 8/1990 Blanchard et al. ..... 361/384
5,150,760 A * 9/1992 Johnson ..... 177/245
5,536,080 A * 7/1996 Madimenos et al. ..... 312/317.1
5,762,409 A * 6/1998 Rice ..... 312/7.2
D402,824 S * 12/1998 Gareau et al. ..... D6/396
6,112,989 A * 9/2000 Sheldon ..... 235/384
6,193,338 B1 * 2/2001 Kocer ..... 312/194

OTHER PUBLICATIONS

Two (2) sheets with pictures of reception podiums at The Westin in San Francisco, CA, circa 1995–Sheet No. 1 and 2.
Three (3) sheets with pictures of reception podiums at The Westin in Santa Clara, CA, circa 1995–Sheet No. 3–5.

(List continued on next page.)

*Primary Examiner*—Leo P. Picard
*Assistant Examiner*—Michael Datskovsky
(74) *Attorney, Agent, or Firm*—Husch & Eppenberger, LLC; H. Frederick Rusche

(57) ABSTRACT

A podium which can operate as a free-standing, self-contained reception station housing any needed electronic equipment within its enclosure, defined by a plurality of upstanding sides and a top surface, having a ventilation system to dissipate from the enclosure any heat generated by the electronic equipment; a retractable, writing shelf for use by handicapped customers; a shelf to support a computer monitor below an opening in the top surface; a series of shelves designed to support a computer printer and its paper supply behind an access panel in one of the upstanding sides; and a trash receptacle housed within the enclosure and accessible through a moving panel in an adjacent upstanding side of the podium.

14 Claims, 8 Drawing Sheets

OTHER PUBLICATIONS

Four (4) sheets with pictures of reception podiums in Ottawa/Ontario, Canada, circa 1995–Sheet No. 6–9.
One (1) sheet with pictures of unfinished reception podiums in Memphis, TN, circa 1995–Sheet No. 10.
Two (2) sheets with pictures of reception podiums in Bowling Green, KY, circa 1995–Sheet No. 11 and 12.
Three (3) sheets with pictures of reception podium in Davenport, IA, circa 1995–Sheet No. 12, 13 and 16.
Three (3) sheets with pictures of reception podiums in Montgomery, AL, circa 1995–Sheet No. 13–15.
Two (2) sheets with pictures of reception podiums in Monterey, CA, circa Oct., 1995–Sheet No. 14 and 17.
One (1) sheet with picture of reception podium in Tuscon, AZ, circa 1996–Sheet No. 18.
One (1) sheet with picture of reception podium in Omaha, NE, circa 1997–Sheet No. 19.
One (1) sheet with picture of reception podium at the World Golf Village in Orlando, FL, circa Apr., 1998–Sheet No. 20.
Advertisement picture of reception podium in Bowling Green, KY, circa Aug. 1995.
Pictures of reception podiums in Montgomery, AL and Monterey, CA, circa 1995.
Advertisement referring to "guest greeting stations," circa 1995.
Advertisement referring to "guest greeting stations," date unknown.
Advertisement referring to "podium check–in," date unknown.
Advertisement showing reception podiums, date unknown.
Advertisement showing reception podium, circa 1995.
Engineering prints for reception podium, Jun. 10, 1996.

* cited by examiner

RECEPTION PODIUM

TECHNICAL FIELD

This invention relates generally to the hotel and restaurant industry and, more particularly, to a novel podium which can operate as a self-contained reception station. The podium is particularly well-suited to house electronic equipment within its enclosure while dissipating the heat generated by the electronic equipment.

BACKGROUND OF THE INVENTION

The success of businesses in the hotel, restaurant and hospitality industry depends, in part, on the ability of these businesses to receive customers in an efficient manner while giving them the individual attention they demand. The traditional form of reception in hotels has been offered through the use of a single large reception desk with several different stations along the length of the desk. Many customers find such a layout impersonal and intimidating. Some businesses in this industry have experimented with individual reception stations as a means to personalize the reception process. The problem this approach presents is that it requires providing all the equipment necessary for the reception process, such as a computer, monitor, printer, paper supply, telephone and trash receptacle, in each station.

One potential solution for this problem is to place the equipment in an enclosure within a free-standing structure which serves as the reception station. However, most electronic equipment generates heat, which must be dissipated if the equipment is housed in an enclosed area. If this heat is not dissipated, the sensitive microprocessors, which are a major source of the heat produced by electronic devices, at the heart of most electronic equipment are at an increased risk of failure. Unfortunately, standard free-standing podiums have no method of dissipating heat.

The appearance of such free-standing stations is another problem. All of the equipment must be hidden from sight to present a clean and organized appearance, while still being easily accessible.

Another problem arises in the accommodation of handicapped customers, particularly those confined to wheelchairs. Reception desks are normally designed for use by standing employees and customers and, therefore, have a top surface at a height that is inconvenient for use by anyone in a sitting position. Such a design fails to provide a writing surface that is accessible to wheelchair-bound patrons.

SUMMARY OF THE INVENTION

According to the present invention, there is provided a reception podium comprising a plurality of upstanding sides and an upper surface which define an enclosure; one or more heat-generating electrical apparatus located within the enclosure; and, a means for actively venting the generated heat from the enclosure. The invention may advantageously include a writing shelf designed for use by handicapped individuals that may be extended for use and retractable into the enclosure during non-use. The present invention also may have a recessed shelf located below an opening in the top surface and designed to support a monitor. A series of shelves within the enclosure designed to support a computer printer and paper supply may also be advantageously included in the invention. The enclosure of the invention may also house a trash receptacle which is accessible via a moving panel in one of the upstanding sides.

One object of the present invention is to provide a self-contained, free-standing reception podium which accommodates all necessary electronic equipment and accessories within its enclosed interior while being able to dissipate any heat generated by the electronic equipment.

Another object is to accommodate handicapped patrons by providing a writing surface positioned for use by individuals confined to wheelchairs or other similar devices.

These and other objects, aspects, features and advantages of the present invention will become apparent from the following detailed description when taken in conjunction with the referenced drawings.

BRIEF DESCRIPTION OF THE DRAWINGS

Reference is now made to the drawings which illustrate the best known mode of carrying out the invention and wherein the same reference numerals indicate the same or similar parts throughout the several views.

DESCRIPTION OF THE PREFERRED EMBODIMENT

Figure 1:
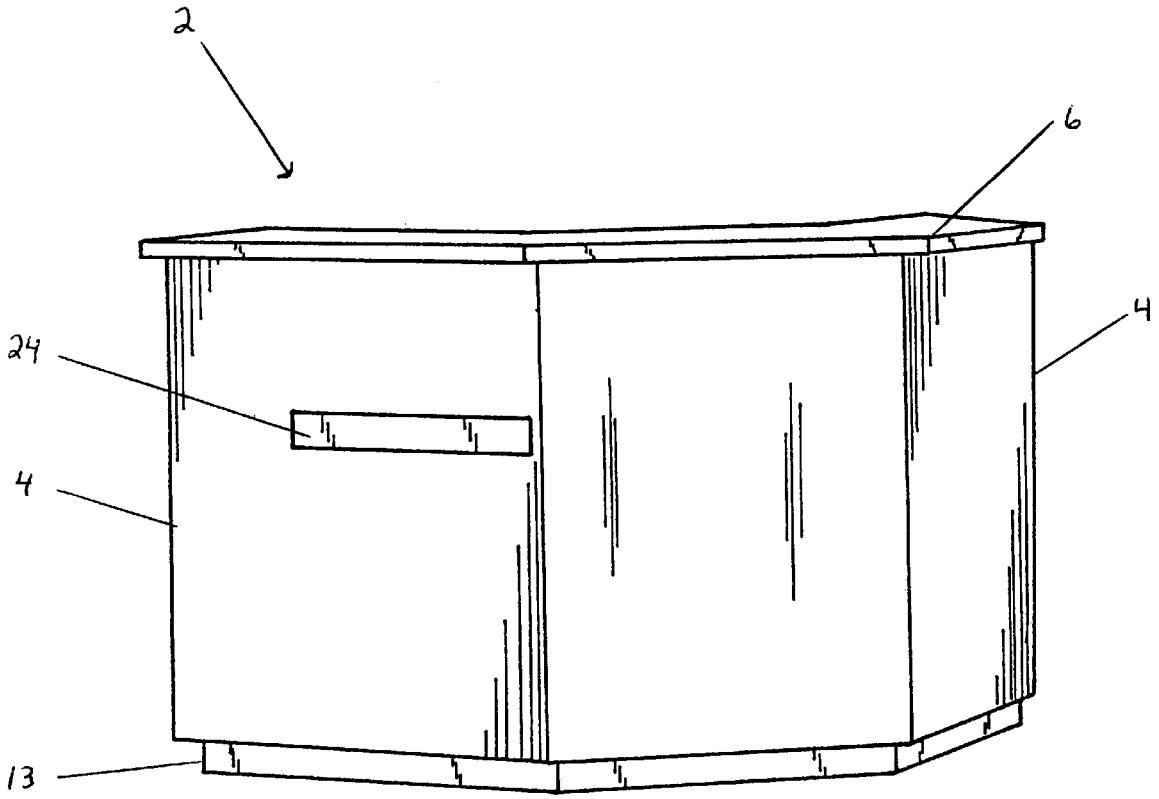
FIG. 1 is a perspective view of a reception podium.
Figure 2:
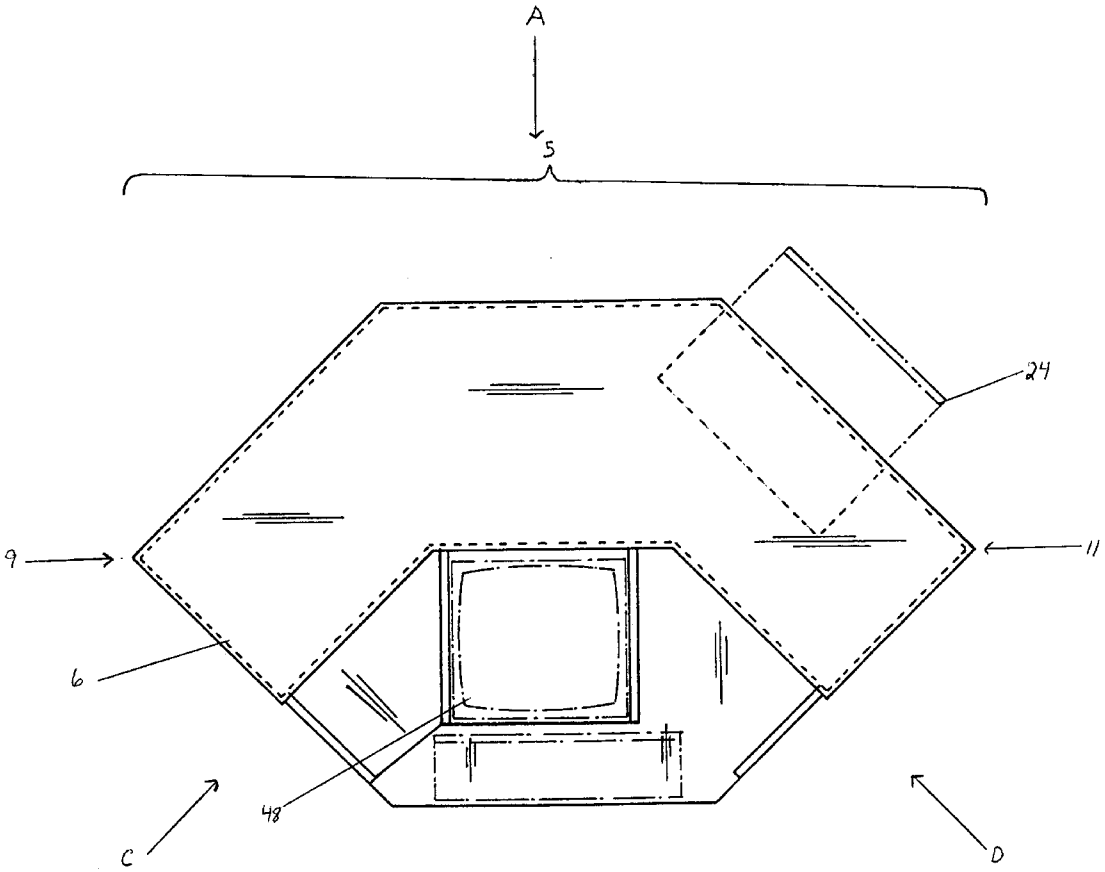
FIG. 2 is a plan view of a reception podium.
Figure 3:
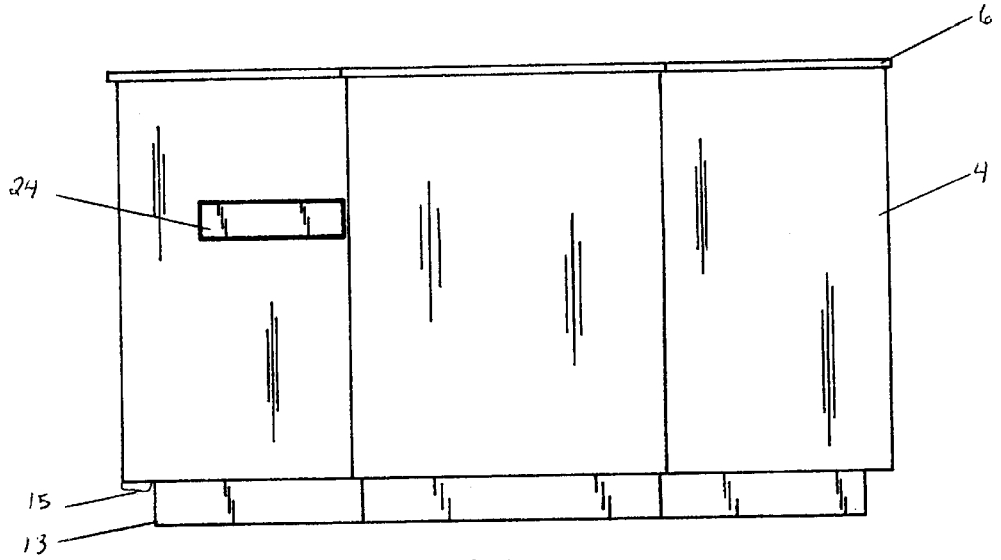
FIG. 3 is an elevation view of a reception podium according to view A of FIG. 2, representing the view of the podium from the customer's side.
Figure 4:
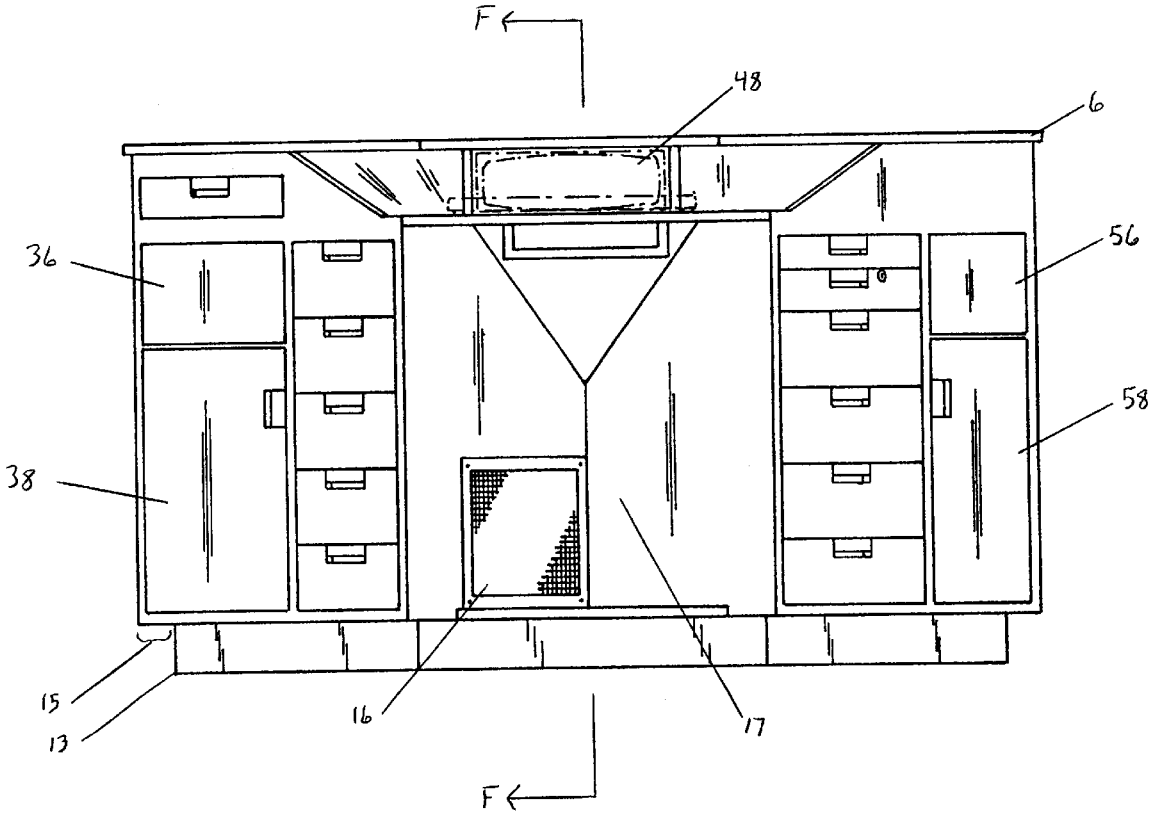
FIG. 4 is an elevation view of a reception podium according to view B of FIG. 2, representing the view of the podium from the employee's side.
Figure 5:
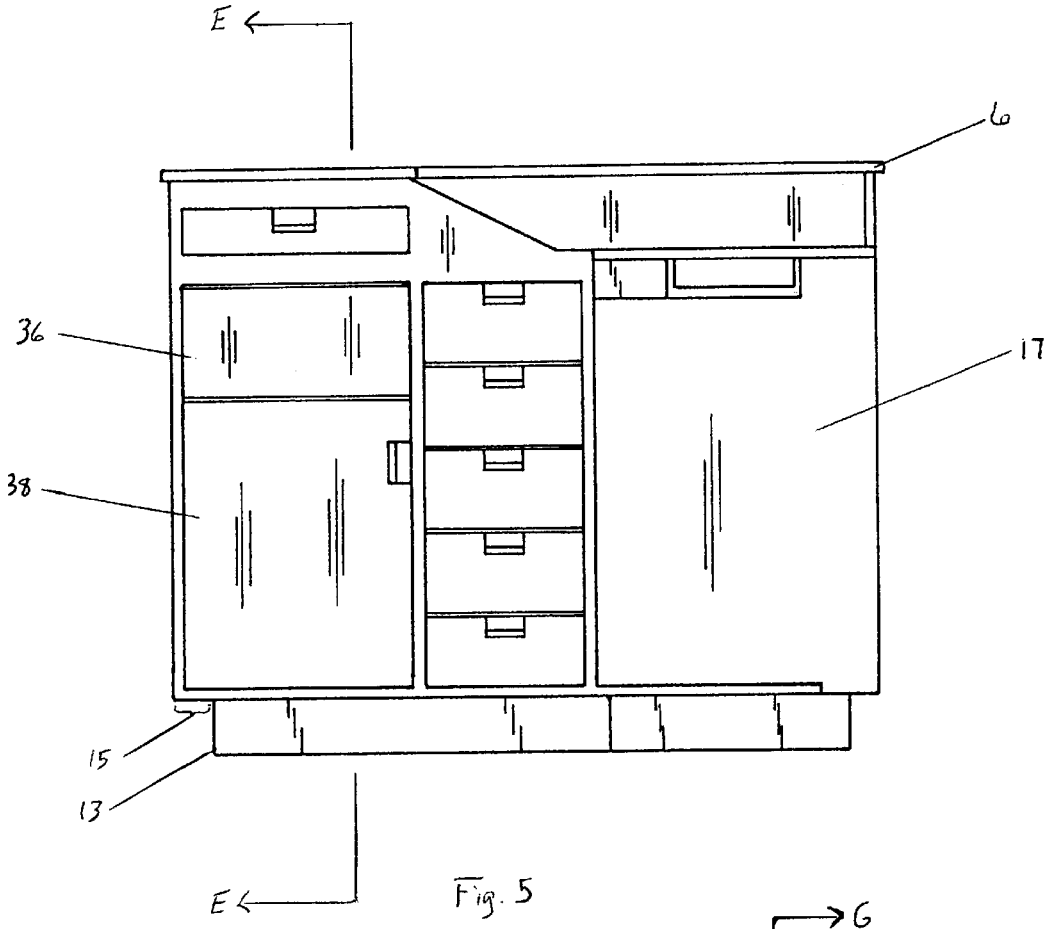
FIG. 5 is an elevation view of a reception podium according to view C of FIG. 2.
Figure 6:
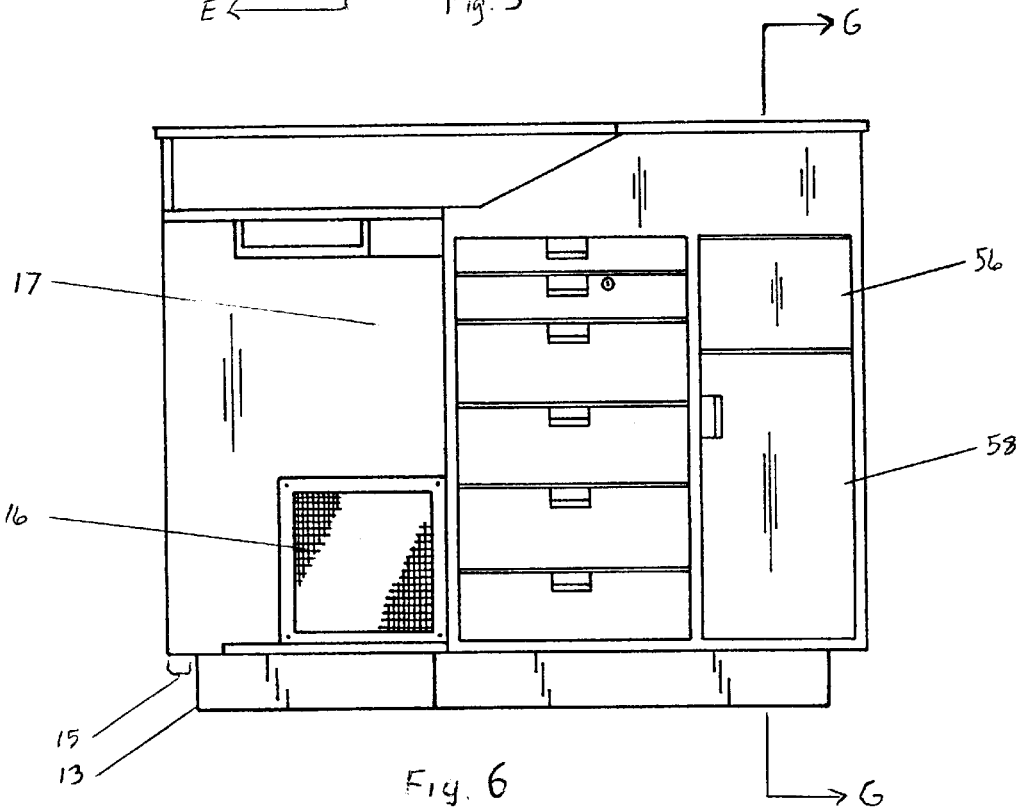
FIG. 6 is an elevation view of a reception podium according to view D of FIG. 2.
Figure 7:
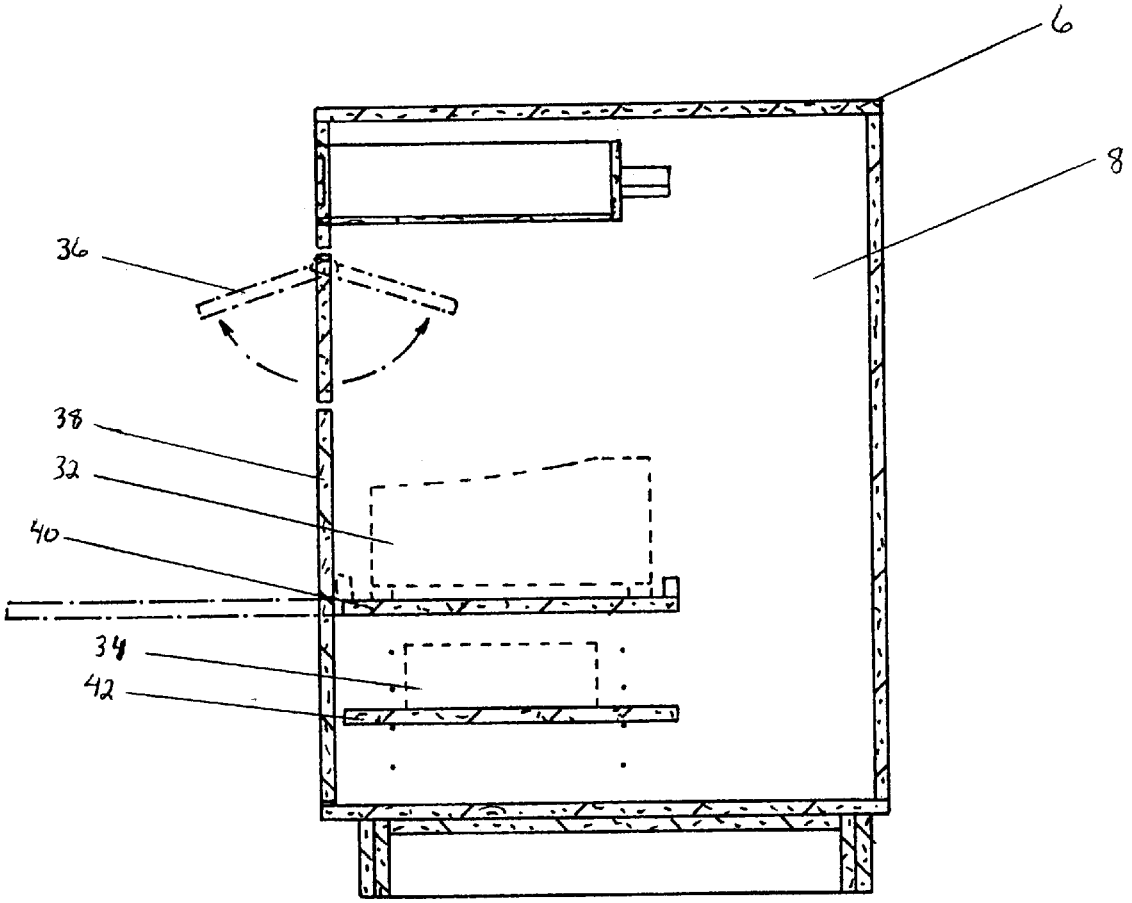
FIG. 7 is a cross-sectional view of a reception podium from section line E—E of FIG. 5, illustrating shelves designed to support a computer printer and a paper supply.
Figure 8:
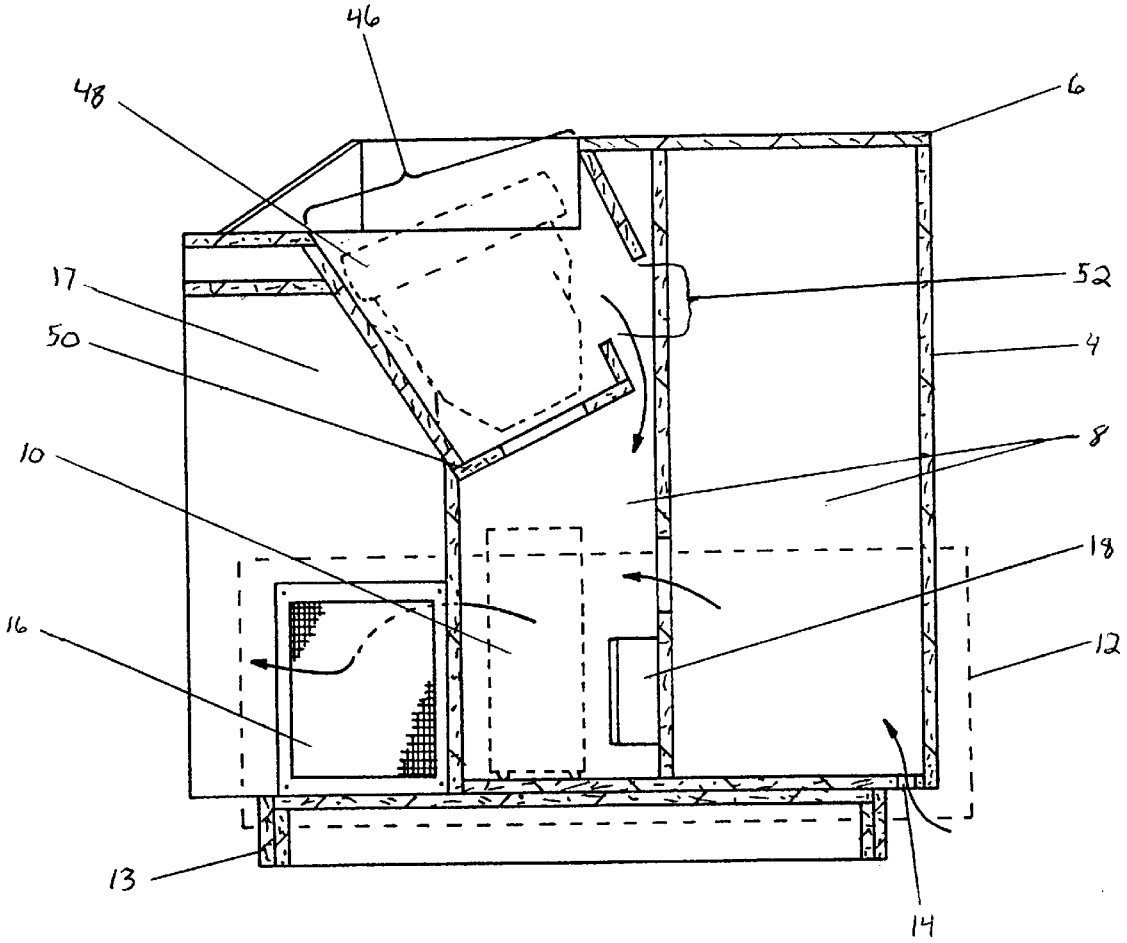
FIG. 8 is a cross-sectional view of a reception podium from section line F—F of FIG. 4, illustrating the enclosure and ventilation system.

A preferred embodiment is shown in FIGS. 1–10 as a podium 2 composed of a plurality of upstanding sides 4 supporting a top surface 6 and forming an enclosure 8, as shown in FIG. 8, within the sides 4 and top surface 6. The structure may have any number of upstanding sides 4, however in the preferred embodiment there will be six sides. As FIG. 2 illustrates, three adjacent sides 4 will define a customer side 5, while the remaining three adjacent sides define an employee side 7. Two ninety degree angles 9, 11 divide the customer side 5 from the employee side 7. This construction provides more useable interior space within the podium 2, while keeping the employee side 7 of the podium 2 completely out of direct sight of customers as they approach the podium 2. Each of the upstanding sides 4 may have a recessed baseboard 13 which creates a slight overhanging area 15 around the bottom of the podium 2, as shown in FIGS. 3–6. This acts as a toespace around the perimeter of the podium 2. On the employee side 7, one of the upstanding sides 4 is provided with a recessed area 17, shown in FIGS. 4–6. This recessed area 17 acts as a kneespace for employees working at the podium 2, adding to the comfort of the workspace.

As seen in FIG. 8, the enclosure 8 provides ample space to house any electronic equipment 10 necessary for the podium 2 to operate as a self-contained reception station. Most electronic equipment tends to generate heat during operation. As shown in FIG. 8, the embodiment provides a means of venting 6 any heat generated by such electronic equipment 10 from the enclosure 8. Ventilation requires the movement of air through the enclosure 8. For this purpose, there is an opening 14 on one side of the podium 2 which acts as an air inlet. There is also an opening 16 on another side of the podium 2 which is intended as an air outlet. A fan 18 is mounted within the enclosure 8 between these two openings 14, 16. The fan 18 circulates air from the air inlet 14 past the heat-generating electronic equipment 10 and to the air outlet 16, thereby providing a constant flow of cooler air to the electronic equipment 10 and thus enabling heat removal.

The air inlet 14 is located at one of the upstanding sides 4 on the customer side 5 of the podium 2 while the air outlet 16 is located at one of the upstanding sides 4 on the employee side 7 of the podium 2. This prevents customers from being subjected to a rush of hot air from the enclosure 8 when they approach the podium 2. As shown in FIG. 8, the recessed area 17 provides the location for the air outlet in the preferred embodiment. This placement conceals the air outlet 16. The air inlet 14 may be located in the overhanging area 15 created by the recessed baseboard 13. This placement completely camouflages the air inlet 14 and keeps it invisible to customers. In addition, the air inlet 14 is considerably smaller than the air outlet 16. This design tends to produce a quieter air flow and reduces the pressure of the air flow as it exits the enclosure 8 through the air outlet 16.

Figure 9:
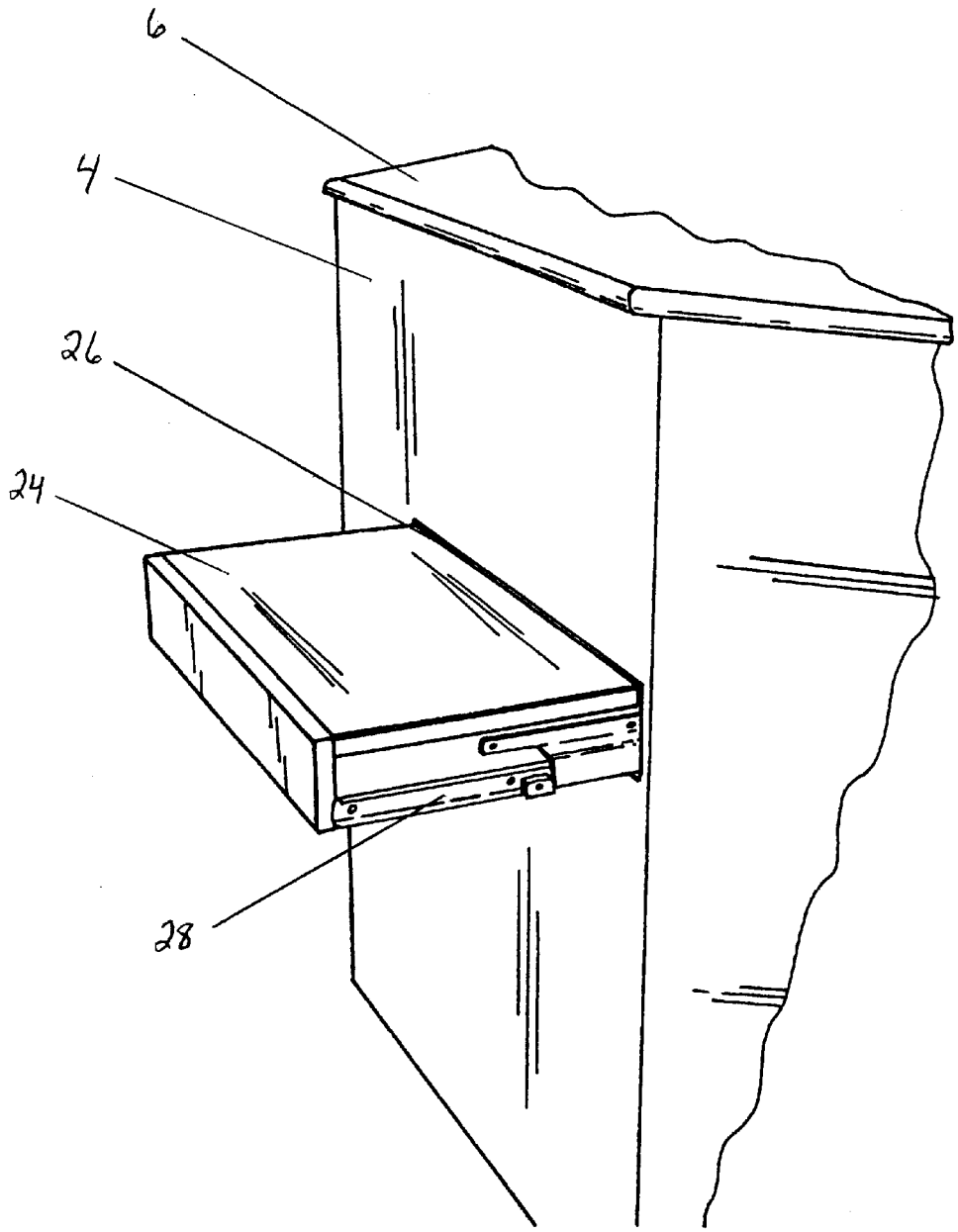
FIG. 9 is a detail view of a retractable writing shelf in an extended position in a reception podium.

FIG. 9 shows a writing shelf 24 that is accessible to handicapped customers. The writing shelf 24 is a horizontal surface that may be moved into either a retracted position when not in use or an extended position when needed. In the retracted position, the writing shelf 24 is housed within the enclosure 8 of the podium 2 and out of sight. An opening 26 in one of the upstanding sides 4 provides access to the enclosure 8 for this purpose. The writing shelf 24 is supported by a pair of sliding support rails 28 and is capable of moving between the retracted position and the extended position through the opening 26. A shown in FIG. 10, the writing shelf 24 may be secured in the retracted position by a locking means 30, such as a spring-loaded magnetic latch, a mechanical latch, a detent in the support rails that limits travel, or any combination of similar means. The use of a spring-loaded magnetic latch to secure the shelf results in a locking system which requires no visible hardware and opens with a simple push of the writing shelf 24. The ability of the writing shelf 24 to open merely with a push enhances the accessibility of the writing shelf 24 to those handicapped customers with limited manual dexterity who would not be able to grasp a handle or other similar hardware.

A computer printer 32 and a paper supply 34 for the printer 32 may also be housed within the podium 2, as shown in FIG. 7. One of the upstanding sides 4 is provided with two moving panels 36, 38 which allows access to the enclosure 8. Two shelves 40, 42, one spaced above the other, are provided within the enclosure 8. One of the shelves 40 supports the printer 32, while the other shelf 42 supports the paper supply 34. The shelf 40 supporting the printer 32 is supported by sliding rails 44 which allows the printer 32 to be moved out of the enclosure 8 for maintenance without the need to lift it.

The podium's surface 6 is provided with an opening 46 large enough to accommodate a standard computer monitor 48, shown in FIG. 8. Immediately below this opening 46, a shelf 50 within the enclosure 8 is designed to support the computer monitor 48. An opening 52 in the shelf 50 allows any heat that may be generated by the monitor 48 to flow into the enclosure 8 where it may be ventilated through the air outlet by the ventilation system 12.

Figure 10:
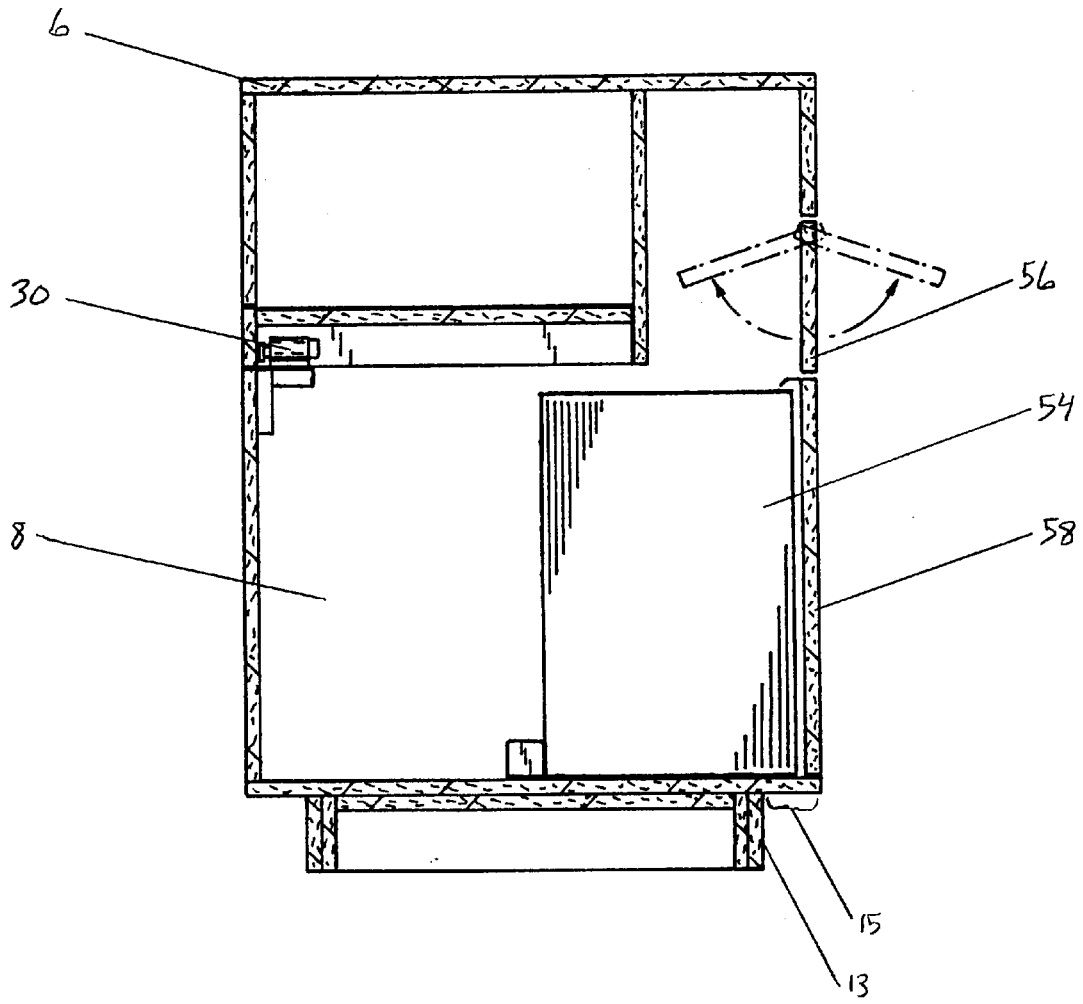
FIG. 10 is a cross-sectional view of a reception podium from section line G—G of FIG. 6, illustrating the trash compartment and a retractable writing shelf in a retracted position.

As shown in FIG. 10, the podium 2 houses a trash compartment within the enclosure 8 of the podium 2. A trash receptacle 54 is provided within the enclosure 8. A first moving panel 56 in one of the upstanding sides 4, provides access to the top of the trash receptacle 54 for quickly depositing trash into the trash receptacle 54. A second moving panel 58 in the same upstanding side 4, allows the trash receptacle 54 to be removed for emptying.

Other objects, features and advantages of the present invention will be apparent to those skilled in the art. While a preferred embodiment of the present invention has been illustrated and described, this has been by way of illustration and the invention should not be limited except as required by the scope of the appended claims.

I claim:

1. A podium including:

a plurality of upstanding sides and an upper surface defining an enclosure;

an electrical apparatus generating heat within the enclosure; and means for ventilating the heat from within the enclosure, comprising:

an opening at the bottom of one of the upstanding sides defining an air inlet;

an opening at another one of the upstanding sides and at a level above the air inlet defining an air outlet; and a fan located within the enclosure and spaced from the air inlet and the air outlet for circulating air from the air inlet to the air outlet.

2. A podium according to claim 1, comprised of six upstanding sides wherein three adjacent sides define a customer side of the podium and the three remaining adjacent sides define an employee side of the podium and wherein the customer side and the employee side are joined by two ninety degree angles.

3. A podium according to claim 2, wherein one of the upstanding sides on the employee side of the podium contains a recessed area acting as a kneespace.

4. A podium according to claim 1, including a recessed baseboard at the bottom of each upstanding side which creates an overhanging area between the recessed baseboard and the upstanding side.

5. A podium according to claim 1, wherein the air inlet is smaller than the air outlet.

6. A podium according to claim 1, including a retractable, handicap-accessible, writing shelf comprising:

an opening in one of the upstanding sides defining an access slot; and, a writing shelf that may be moved through the access slot between a retracted position in which the writing shelf is housed within the enclosure and an extended position in which the writing shelf is outside of the enclosure;

a locking means, whereby the writing shelf may be secured in the retracted position.

7. A podium according to claim 6, wherein the writing shelf is supported during movement between the extended position and retracted position by a sliding rail on either side of the writing shelf.

8. A podium according to claim 6, wherein the locking means comprises a spring-loaded magnetic latch.

9. A podium according to claim 1, further comprising:

an opening in the surface;

an angled shelf within the enclosure and below the opening in the surface and having a vent therein, whereby a computer monitor may be supported by the angled shelf and viewed through the opening in the surface and whereby heat generated by the computer monitor may be drawn through the vent by the fan and out of the enclosure through the air outlet.

10. A podium according to claim 1, including a means for supporting a computer printer and a supply of paper for the computer printer, comprising:

a shelf within the enclosure to support the computer printer;

a shelf to support the supply of paper within the enclosure and adjacent to the shelf supporting the computer printer; and, a moveable panel in one of the upstanding sides adjacent to the shelves which allows access to the shelves.

11. A podium according to claim 1, including a trash compartment comprising:

a removable trash receptacle within the enclosure; and, a moveable panel in one of the upstanding sides adjacent to the trash receptacle which allows access to the trash receptacle.

12. A podium including:

six upstanding sides and an upper surface defining an enclosure, wherein three adjacent sides define a customer side of the podium and the three remaining adjacent sides define an employee side of the podium and wherein the customer side and the employee side are joined by two ninety degree angles;

an electrical apparatus generating heat within the enclosure; and means for ventilating the heat from within the enclosure, comprising:

an opening at the bottom of one of the upstanding sides on the customer side of the podium defining an air inlet;

an opening at one of the upstanding sides on the employee side of the podium defining an air outlet; and a fan located within the enclosure and spaced from the upstanding sides for circulating air from the air inlet to the air outlet.

13. A podium including:

six upstanding sides and an upper surface defining an enclosure, wherein three adjacent sides define a customer side of the podium and the three remaining adjacent sides define an employee side of the podium and wherein the customer side and the employee side are joined by two ninety degree angles and wherein one of the upstanding sides on the employee side of the podium contains a recessed area acting as a kneespace;

an electrical apparatus generating heat within the enclosure; and means for ventilating the heat from within the enclosure, comprising:

an opening at the bottom of one of the upstanding sides defining an air inlet;

an opening located in the recessed area defining an air outlet; and a fan located within the enclosure and spaced from the upstanding sides for circulating air from the air inlet to the air outlet.

14. A podium including:

a plurality of upstanding sides and an upper surface defining an enclosure;

a recessed baseboard at the bottom of each upstanding side which creates an overhanging area between the recessed baseboard and the upstanding side;

an electrical apparatus generating heat within the enclosure; and means for ventilating the heat from within the enclosure, comprising:

an opening in the overhanging area at the bottom of one of the upstanding sides defining an air inlet;

an opening at another one of the upstanding sides defining an air outlet; and a fan located within the enclosure and spaced from the upstanding sides for circulating air from the air inlet to the air outlet.

* * * * *